United States Patent [19]

Frye

[11] Patent Number: 4,746,046

[45] Date of Patent: May 24, 1988

[54] FASTENER ADVANCING DEVICE

[75] Inventor: Maurice D. Frye, Mt. Orab, Ohio

[73] Assignee: Senco Products, Inc., Cincinnati, Ohio

[21] Appl. No.: 880,057

[22] Filed: Jun. 30, 1986

[51] Int. Cl.[4] ..... B25C 5/16

[52] U.S. Cl. ..... 227/120; 192/56 R; 221/258; 227/156

[58] Field of Search ..... 192/56 R; 221/224, 277, 221/258; 227/120, 156, 76, 3

[56] References Cited

U.S. PATENT DOCUMENTS

| | | | |
|---|---|---|---|
| 979,104 | 12/1910 | Smith | 192/56 R |
| 1,211,515 | 1/1917 | Winter | 192/56 R |
| 2,005,589 | 6/1935 | McCoy | 221/258 X |
| 3,189,220 | 6/1965 | Mullaney | 227/120 X |
| 3,604,608 | 9/1971 | Mullaney et al. | 227/120 |
| 3,622,061 | 11/1971 | Hoyer et al. | 227/120 |
| 4,074,542 | 2/1978 | Hankosky et al. | 192/56 R X |
| 4,151,944 | 5/1979 | Picton | 227/120 |
| 4,574,991 | 3/1986 | Thorsen, Jr. | 227/3 |

*Primary Examiner*—Paul A. Bell
*Attorney, Agent, or Firm*—Frost & Jacobs

[57] ABSTRACT

The present invention provides a device for advancing fasteners in a magazine to a fastening tool. A plate assembly includes a base plate rigidly connected to a feed track and a pivot plate pivotally connected in a parallel orientation to the base plate. A motor is mounted to the pivot plate in such a manner that the motor shaft projects through apertures near the center of each plate. A clutch assembly is mounted to the motor shaft and engages fasteners on the feed track. As the motor shaft rotates, the clutch assembly provides a friction force for advancing fasteners along the rack as each fastener is ejected. Between fastener ejections, the clutch assembly rotates and slips about the motor shaft.

16 Claims, 4 Drawing Sheets

FASTENER ADVANCING DEVICE

BACKGROUND OF THE INVENTION

1. Field of the Invention

The present invention relates generally to fasteners, and more particularly is concerned with a device for continuously advancing fasteners in a magazine for a fastener driving device.

2. Description of the Prior Art

Fastening tools are used by industrial employees, construction workers, and even homeowners. Fastening tools provide an economical and efficient means for fastening parts and pieces together and are frequently utilized in a wide variety of industries. A representative example of such a device is shown and described in U.S. Pat. No. 2,983,922, which is assigned to the assignee of the present invention.

Generally, fasteners for such tools are carried within a magazine. The magazine may be an integral part of the tool, or may be separately mounted on the tool. Fasteners are fed forward within the magazine such that the forwardmost fastener is positioned beneath the driver such that it can be driven from the tool into a workpiece upon activation of the tool.

For continuous operation of a fastening tool, it is important to maintain a constant forward force on a row of fasteners so that the fasteners advance within the magazine as each one is driven. Such force causes the fasteners to advance so that the next fastener in line will be positioned properly after the previous fastener has been driven. In desk staplers and in many industrial tools, this force is often applied by a spring-biased member which slides behind a row of fasteners and causes the fasteners to advance as the first fastener in a row is ejected.

Oftentimes, automatic fastening devices, either pneumatically or electronically powered, are used in high volume, high speed production areas. An example of this is taught and described in U.S. Pat. No. 4,562,949. The apparatus shown in this patent uses a plurality of stapling tools for the purpose of constructing lattice automatically and continuously with a minimum of labor.

Devices such as that shown in U.S. Pat. No. 4,562,949 drive a large number of fasteners in a short period of time; thus, it is necessary to often replenish the supply of fasteners for the magazines of the stapling tools. If the tools use a spring-biased member to advance the fasteners in the magazine, it is a very time-consuming task to replenish the fastener supply, which task may greatly reduce the efficiency and speed that the device is designed to provide, especially if there is a large quantity of tools having magazines which hold a limited number of fasteners.

In some applications, devices have been designed to continuously supply fasteners to a fastener-driving tool. Examples of these types of devices are shown in U.S. Pat. Nos. 3,604,608 and 4,574,991. However, devices such as these are typically relatively complex, using pneumatic cylinders to load and position staples for use in fastener driving tools. The drawbacks of such devices include reliability problems (due to the complexity of the systems), and the cost.

Another device for storing and supplying a large number of fasteners to a fastener driving device without stopping to reload is shown and described in U.S. Pat. No. 3,189,220. The device taught therein has a storage section which accommodates a large number of staples in the form of sticks or strips of detachable joined fasteners. The strips of staples are discharged transversely from the storage section against a stop, and guide means are provided interconnecting the storage section and the stop with the staple feed track for receiving a strip of staples from the storage section and advancing strips onto the staple feed track. A continuously driven fastener advancing mechanism is provided for resiliently bringing the staples in the guide into and toward the discharge end of the feed track and also for advancing sticks of staples from the storage section in driving engagement along the guide.

While this device is much simpler than the aforementioned patents, it still employs a bevel gear assembly to drive both a friction staple driving apparatus and a belt driven staple advancing pulley assembly from a single continuously operating motor. The staple driving apparatus uses a spring as a lost motion connection between the bevel gear assembly and the staple driving wheel such that the wheel responds in an intermittent advancement to the continuous drive of the gear assembly, with the driving wheel slipping when the spring is stretched to its limit. The O-ring belt which frictionally engages the staples also slips as the continuously operating motor slightly overdrives the staple advancing mechanism. As a result, there is constant wearing of some of the parts of this device, which may cause feeding problems.

Another problem which can effect the operation of the device taught in U.S. Pat. No. 3,189,220 is caused by the breaking of the staple strips. Although the staples are fastened together by glue, tape, or some other adhesive, it is not uncommon for these strips to break apart while being handled. This could possibly cause a feed problem in this system.

Consequently, a need exists for improvements in devices for continuously supplying fasteners to a fastener tool. A device should be easy to install, simple to operate, inexpensive to manufacture, and need a minimum of maintenance. The device should advance fasteners into a magazine so that each fastener is properly aligned for ejection.

SUMMARY OF THE INVENTION

The present invention provides an economical device for advancing fasteners in a magazine to a fastening tool. The advancing device can be installed on existing applications without interfering with or requiring major modification of fastening tools or production lines. The device applies a constant force on a row of fasteners so that each fastener advances properly for ejection.

The present invention makes it possible for a person to quickly and easily replenish the fastener supply for a plurality of fastening tools in a short period of time. It is only necessary to load new strips of staples on the feed track of each tool; there is no spring-biased feeder shoe to remove from the feed track in order to add additional fasteners. In addition, the fastener supply can be replenished while the tools are in use, since reloading does not affect operation of the tools. Finally, due to simplicity of the design of the fastener advancing device of the present invention, maintenance needs of the system are drastically decreased, thereby increasing reliability and productivity.

The present invention provides a device for advancing fasteners in a magazine to a fastening tool. A plate assembly includes a base plate rigidly connected to a feed track and a pivot plate pivotally connected in a parallel orientation to the base plate. A motor is mounted to the pivot plate in such a manner that the motor shaft projects through apertures near the center of each plate. A clutch assembly is mounted to the motor shaft and engages fasteners on the feed track. As the motor shaft rotates, the clutch assembly provides a friction force for advancing fasteners along the rack as each fastener is ejected. Between fastener ejections, the clutch assembly rotates and slips about the motor shaft.

DETAILED DESCRIPTION OF THE PREFERRED EMBODIMENT

Figure 1:
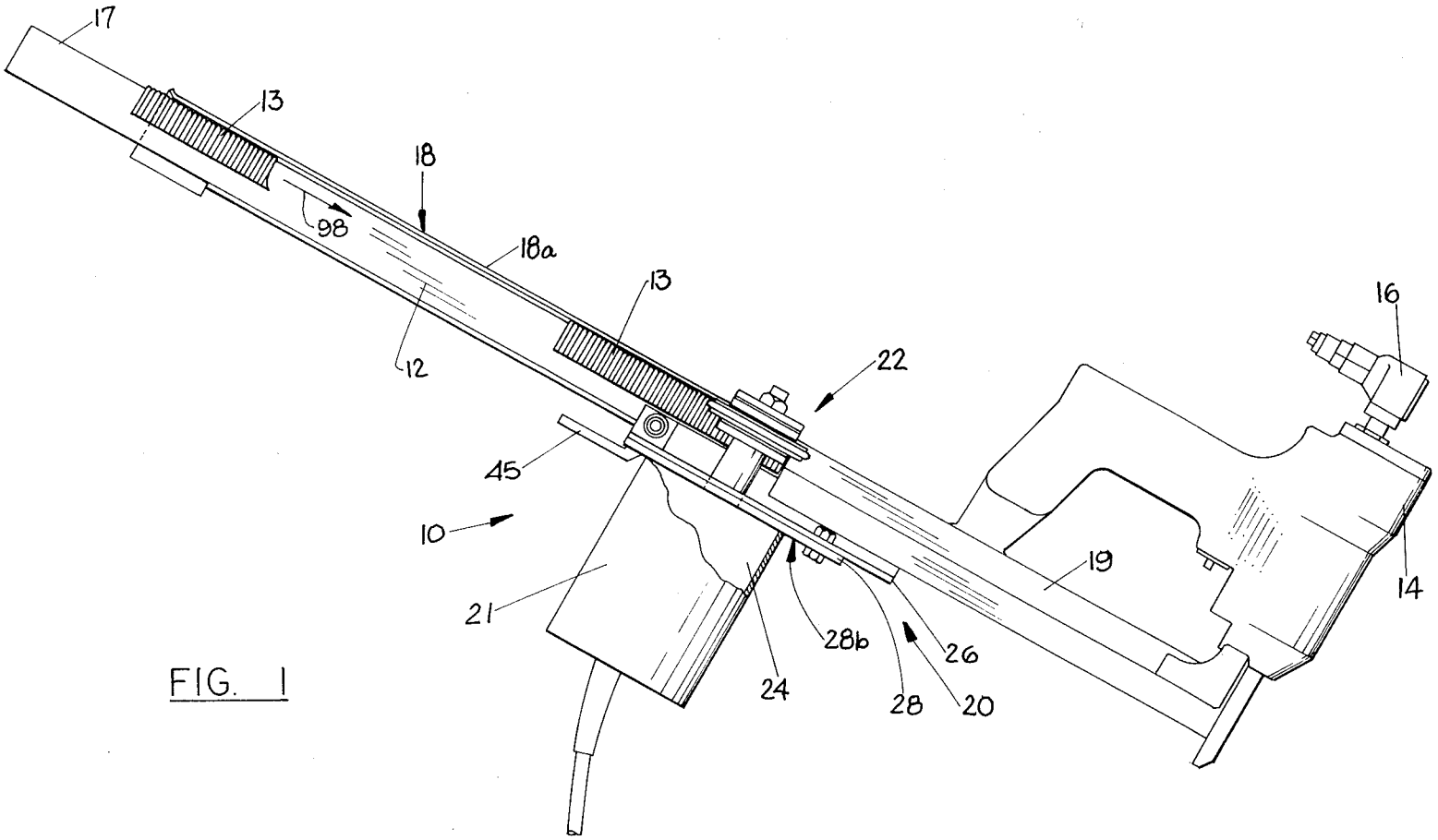
FIG. 1 is a fragmentary, side elevational view of an embodiment of the present fastener advancing device mounted on a conventional fastener driving tool.
Figure 2:
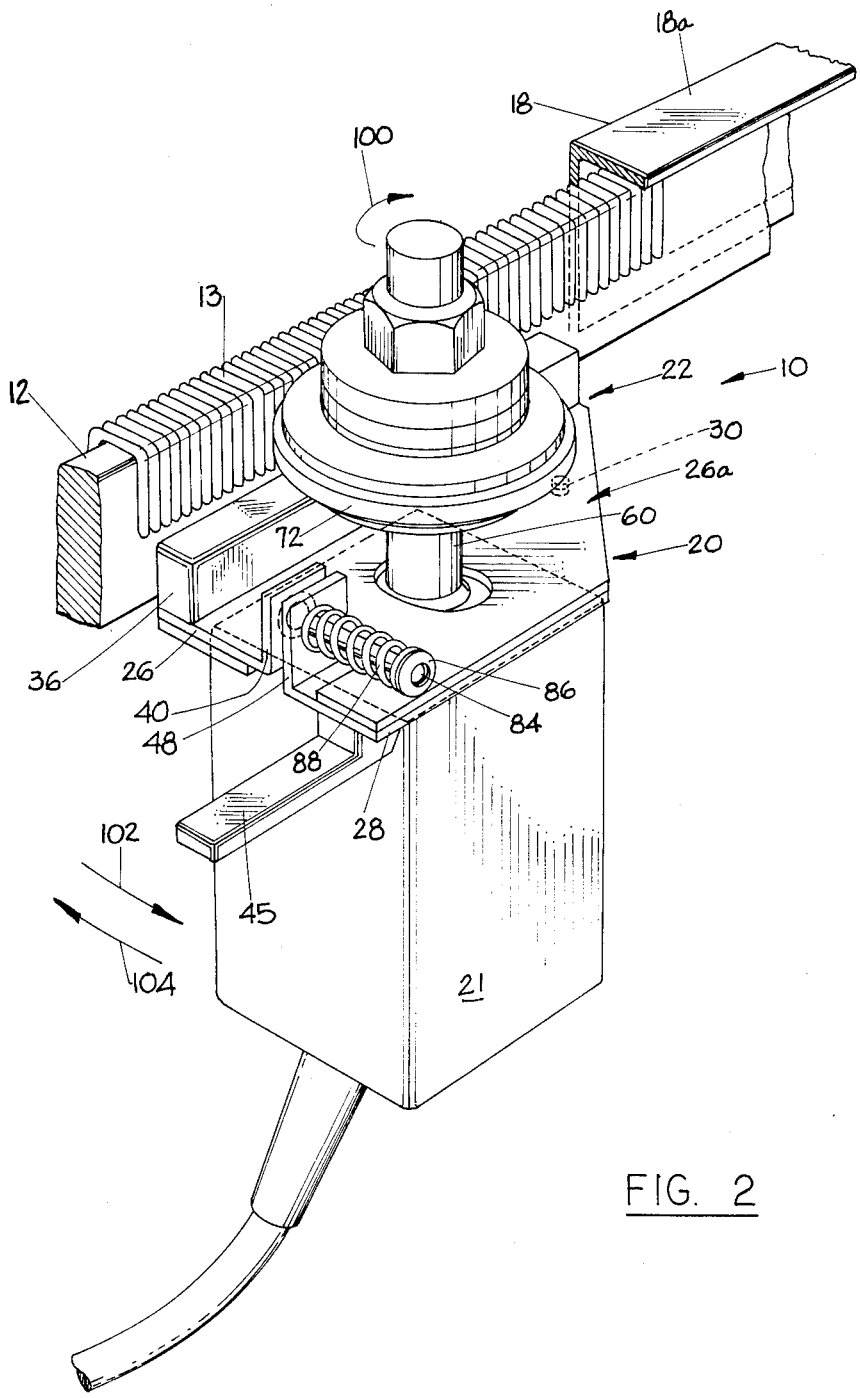
FIG. 2 is an enlarged, perspective view of the fastener advancing device of FIG. 1.

An embodiment of the fastener advancing device of the present invention is indicated generally at 10 in FIGS. 1 and 2. The device 10 is mounted to a feed track 12. Track 12 is a longitudinal member having a cross section of suitable size to receive staples 13. A conventional industrial stapling tool 14 is mounted such that feed track 12 comprises a magazine for tool 14. The length of feed track 12 may be selected for optimum efficiency in terms of necessary quantity of staples, physical space available for mounting, etc. The stapling tool 14 depicted in FIG. 1 includes an air fitting 16 for pneumatic operation in a manner well known in the art. Staples 13 straddle feed track 12 and are placed on an elevated end 17 of track 12. As staples 13 are driven from tool 14, gravity causes the staples 13 to slide down the incline of feed track 12 and said staples are urged into tool 14 by advancing device 10. A cover 18 having a lip 18A projecting over the staples 13 is mounted to feed track 12 to prevent staples 13 from vibrating from feed track 12 when stapling tool 14 is in operation. A side panel 19 is provided on the cover 18 along the portion between the advancing device 10 and the stapling tool 14 to further prevent staples 13 from vibrating from feed track 12.

The advancing device 10 of the present invention is mounted along track 12 a suitable distance away from the staple tool 14 so as to avoid interference with operation of the tool 14. The device 10 includes a plate assembly 20, a clutch assembly 22 and a motor 24. A shroud 21, constructed from rubber or other material to resist moisture and other elements of the environment, is mounted on the motor 24. In FIG. 1, the upper right-hand portion of the shroud 21 is broken away to show the motor 24 mounted to the plate assembly 20.

The plate assembly 20 includes an upper or base plate 26 and a lower or pivot plate 28. The plates 26 and 28 are mounted to feed track 12 in a parallel orientation with respect to each other. The pivot plate 28 pivots with respect to the base plate 26 about a pivot pin 30 in a manner described below.

Figure 3:
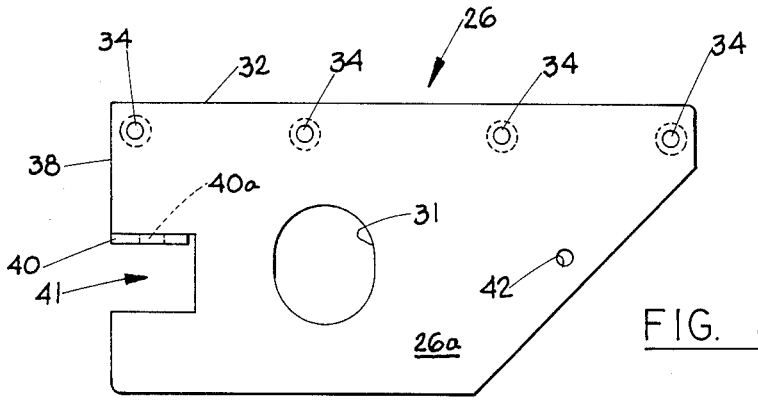
FIG. 3 is a top plan view of a base plate of the present device.

As illustrated best in FIG. 3, the base plate 26 is a planar member having an oval aperture 31 near its central portion. Four openings 34 are aligned along a first edge 32 of the base plate 26. Fasteners (not shown) such as screws pass through the openings 34 to secure a block member 36 to an upper surface 26A of the base plate 26 as illustrated in FIG. 2. It is preferred that the openings 34 are countersunk so that the fasteners will be flush with the surface of the plate 26. It is also preferred that the length of the block member extend the length of the first edge 32 of base plate 26. The block member 36 is securely connected to feed track 12 by fasteners (not shown), welding or other suitable means. The height of the block member 36 is selected so as not to interfere with staples on track 12. If desired, a shoulder or flange can be provided along the first edge 32 of the base plate 26 in lieu of the block member 36 to provide a surface for mounting to track 12.

Along a second edge 38 of the base plate 26, a tab 40 and an indentation or notch 41 are provided. The tab 40 projects upwardly (substantially perpendicularly) from the plane of the plate 26. The tab 40 includes an opening 40A near its central portion. A pivot pin opening 42 is provided in the plate 26 opposite the oval aperture 31 from the notch 41. The purpose and use of the aperture 31, the tab 40 and pin opening 42 are described below.

Figure 4:
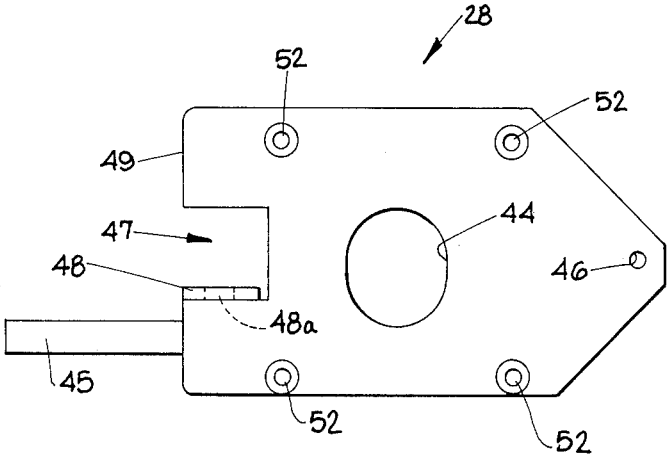
FIG. 4 is a top plan view of a pivot plate of the present device.

The pivot plate 28, as illustrated in FIG. 4, is a planar member having an oval aperture 44 near its central portion. It is preferred that the width of the pivot plate 28 be substantially equal to the width of the base plate 26 and that aperture 44 align with and be the same size as aperture 31. As shown in FIG. 2, the pivot plate 28 is mounted beneath the base plate 28. A pin opening 46 is provided in the pivot plate 28 to align with pin opening 42 in base plate 26. The pivot pin 30 is inserted and extends through pin openings 42 and 46 when the base plate 26 and the pivot plate 28 are aligned. The pin 30 is held in place by any suitable fasteners 50 (shown only in FIG. 1 and removed from FIG. 2 for purposes of clarity of illustration).

Edge 49 of the pivot plate 28 aligns with edge 38 of the base plate 26. A tab 48 and a notch 47 are provided along edge 49. The tab 48 projects upwardly (substantially perpendicularly) from the plane of the plate 28 and includes an opening 48A near its central portion. A handle or lever 45 projects outwardly from edge 49. The purpose and use of the aperture 44, lever 45 and tab 48 are described below.

A motor 24 is mounted to a lower surface 28B of the pivot plate 28 opposite the base plate 26. Fasteners (not shown) pass through countersunk openings 52 in the pivot plate 28 to secure the motor 24 to the plate 28 in a manner well known in the art. The motor 24 (either electrically, pneumatically, or hydraulically powered) includes a conventional shaft 25 (shown only in FIG. 5). It may be desirable to employ a combined motor/speed reducer unit to provide a slower rotation to the shaft 25. Shaft 25 is inserted through the oval apertures 31 and 44 of the base plate 26 and the pivot plate 28, respectively. The shaft 25 projects upwardly (substantially perpendicularly) from the upper surface 26A of the base plate 26.

Figure 5:
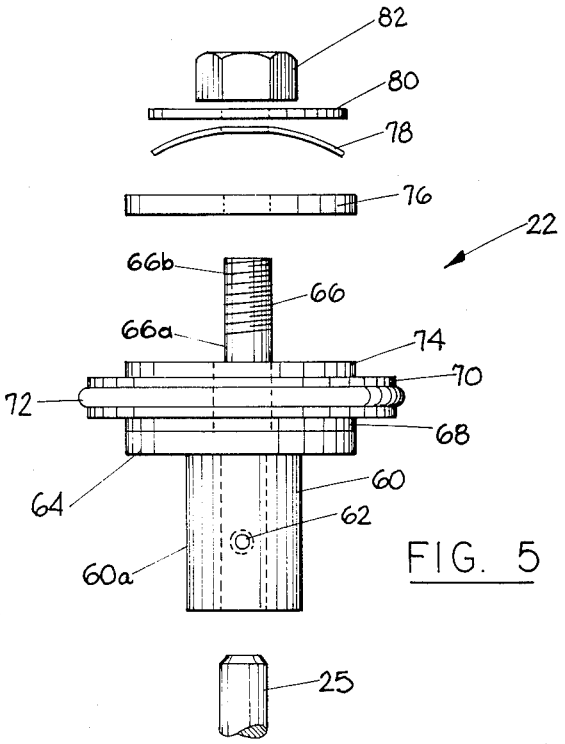
FIG. 5 is a partially-exploded, side elevational view of a clutch assembly of the present device.

The clutch assembly 22 is mounted on the shaft 25. As illustrated in FIG. 5, a collar 60 is inserted over the shaft 25 and securely mounted by a set screw (not shown) threaded into screw opening 62. The collar 60 includes a mounting flange 64 and a stud shaft 66 extending axially along the longitudinal axis of the motor/reducing shaft 25. The mounting flange 64 has a diameter greater than that of the base portion 60A of the collar 60. The collar 60, mounting flange 64 and stud shaft 66 are of unitary construction and rotate with the motor shaft 25 at a constant speed.

A first slippage washer 68 is axially mounted on the stud shaft 66 adjacent the mounting flange 64. Next a drive wheel 70, having a circumferential groove, is axially mounted on the stud shaft 66. An elastomeric member 72 such as an O-ring is contained within said groove. A second slippage washer 74 is axially mounted on the stud shaft 66 adjacent the drive wheel 70. It is preferred that the first and second slippage washers be constructed of a polymeric material such as DELRIN, nylon, or teflon. Both the slippage washers 68 and 74 and the drive wheel 70 freely rotate about the stud shaft 66 in a manner described below.

Next a thrust disk 76 is axially mounted on the stud shaft 66 in such a manner that the disk 76 rotates with the collar 60. In other words, as the motor shaft 25 is rotated, the thrust disk 76 is locked on the stud shaft 66 and rotates at the same speed. This can be accomplished by forming a cam near the middle portion 66A of the stud shaft 66 and providing a corresponding opening in the thrust disk 76. A tension washer 78 is axially mounted on the stud shaft 66 adjacent the thrust disk 76. An upper disk 80 is axially locked on the stud shaft 66 in a manner similar to the thrust disk 76 adjacent to the tension washer 78. A nut 82 is mated with a threaded portion 66B of the shaft 66. The nut 82 allows adjustability of the amount of tension applied by the washer 78 on the drive wheel 70. As the nut is tightened, the drive wheel 70 rotates less freely. The slippage washers 74 permit and enhance the ability of the drive wheel 70 to act as a rotatable clutch.

As illustrated best in FIG. 2, the tab 48 of the pivot plate 28 projects through the notch 41 of the base plate 26 so that the tabs 40 and 48 face each other. A stem 84 having a stop end 86 is securely mounted to the tab 40 at opening 40A and projects through opening 48A. A helical spring 88 is mounted between tab 48 and the stop end 86. The force of the spring 88 urges the pivot plate 28 toward feed track 12 until the O-ring 72 of the clutch assembly 22 is in contact with the staples 13.

In operation, staples 13 slide along feed track 12 as indicated by arrow 98 and reach the advancing device 10. The motor reducer 24 is operated so that the shaft 25 and clutch assembly 22 rotate in the direction of arrow 100 (FIG. 2). The O-ring 72 engages the staples 13 and forces them toward tool 14. As the collar 60 and stud shaft 66 rotate, the drive wheel 70 slips on the shaft until a staple is ejected from tool 14. Once a staple 13 is ejected, the row of staples 13 advance. The friction between the O-ring 72 and the staples 13 provides a force for staple advancement. Between staple ejections, the drive wheel 70 slips about the stud shaft 66. The advancing device 10 permits a continuous feed of staples 13 to the staple tool 14 without interference to operation of the staple tool 14 or the assembly line.

The collar 60 moves in oval apertures 31 and 44 away from feed track 12 as the pivot plate 28 moves. When the O-ring 72 is disengaged, staples 13 can be lifted on track 12 away from the staple tool 14 or slid past the advancing device 10 toward the tool 14.

To disengage the O-ring 72 from the staples 13, a force is applied to the lever 45 in the direction of arrow 102 (FIG. 2). At such time a force is applied, the spring 88 compresses and permits the pivot plate 28 to pivot about pivot pin 30 away from feed track 12. To reengage the O-ring 72, the force is released from the lever 45. The spring 88 urges tab 48 and the pivot plate 28 to their approximate original position as indicated by direction arrow 104.

If preferred, an idler bearing (not shown) may be mounted to feed track 12 opposite the present device 10. The bearing can be mounted on a bracket which is welded or otherwise mounted to the rack. The bearing can reduce friction between track 12 and the inside leg of staples 13.

Although the present invention has been described with reference to a preferred embodiment, workers skilled in the art will recognize that changes may be made in form and detail without departing from the spirit and scope of the invention. For example, when tool 14 is mounted at such an angle that gravity causes staples 13 to travel freely along feed track 12, the location of fastener advancing device 10 may be close to tool 14 so as to avoid interference with its operation. However, if tool 14 is mounted such that the effect of gravity upon the movement of staples 13 along feed track 12 is minimized, it would be more advantageous to mount device 10 to feed track 12 at a more remote distance from tool 14 to insure consistent feeding.

What is claimed is:

1. A device for advancing fasteners along a guide means for a fastener driving tool comprising:

(a) a plate assembly connected to said guide means, said plate assembly including
  (i) a base plate connected to said guide means and projecting from one side thereof and including an aperture near its central portion; and
  (ii) a pivot plate pivotally connected to and aligned with said base plate, said pivot plate having an aperture aligned with said base plate aperture;

(b) drive means connected to said pivot plate opposite said base plate, said drive means having a rotatable shaft projecting through said apertures of said base and pivot plates; and (c) clutch means mounted on said rotatable shaft for frictionally engaging and advancing said fasteners along said guide means.

2. The device as claimed in claim 1 wherein said clutch means further comprises:

(a) a collar removably mounted on said rotatable shaft, said collar having a mounting flange adjacent its first end and a stud shaft at its second end extending axially along a longitudinal axis of said rotatable shaft;

(b) a first slippage washer axially mounted on said stud shaft adjacent said mounting flange and rotatable thereabout;

(c) a drive wheel having a circumferential groove for receiving an elastomeric member, said drive wheel axially mounted on said stud shaft adjacent said first slippage washer and rotatable thereabout;

(d) a second slippage washer axially mounted on said stud shaft adjacent said drive wheel and rotatable thereabout;

(e) a thrust disc axially mounted on said stud shaft adjacent said second slippage washer;

(f) a tension washer axially mounted on said stud shaft adjacent said thrust disc;

(g) a disc axially mounted on said stud shaft adjacent said tension washer; and (h) a nut mated to said stud shaft for adjusting said tension washer and rotatability of said drive wheel.

3. The device as claimed in claim 2, further including a spring mounted to said base plate and biased against said pivot plate for engaging said elastomeric member contained on said drive wheel with said fasteners.

4. The device as claimed in claim 3, further including a lever extending from said pivot plate for manually shifting said elastomeric member contained on said drive wheel out of contact with said fasteners.

5. The device as claimed in claim 4 wherein said first and second slippage washers are constructed from a polymeric material.

6. The device as claimed in claim 2 wherein said elastomeric member comprises an O-ring.

7. The device as claimed in claim 1, further including a shroud to protect said drive means from the environment.

8. A device for intermittently advancing staples along a feed track to a staple driving device as each staple is driven into a workpiece, comprising:

(a) an upper plate having a central aperture connected to said feed track;

(b) a lower plate having a central aperture pivotally connected to said upper plate;

(c) a helical spring mounted to said upper plate and biased against said lower plate;

(d) motor means, connected to said lower plate opposite said upper plate, having a rotatable shaft projecting through said plate apertures;

(e) a rotatable clutch assembly mounted on said motor means shaft for frictionally engaging and advancing said staples, said clutch assembly comprising a drive wheel mounted between two slippage washers, whereby the bias force of said spring engages said drive wheel with said staples and said drive wheel slips about said clutch assembly until a staple is driven by said staple driving device.

9. The device as claimed in claim 8, further including means for adjusting the rotational slippage of said drive wheel about said clutch assembly.

10. The device as claimed in claim 9 wherein said clutch assembly further includes:

(a) a collar having a stud shaft for axially receiving said drive wheel and said slippage washers; and (b) a retainer nut mated to said stud shaft for adjusting a tension washer adjacent said drive wheel.

11. A device for successively advancing strips of adhered staples along a feed track of a staple driving device, comprising:

(a) a base plate connected to said feed track and projecting from one side thereof and including an aperture near its central portion;

(b) a pivot plate pivotally connected to and aligned with said base plate and including an aperture near its central portion aligned with said base plate aperture;

(c) drive means connected to said pivot plate opposite said base plate and including a rotatable shaft projecting through said apertures of said base plate and pivot plate;

(d) clutch means mounted to said drive means shaft for frictionally engaging and advancing strips of staples, said clutch means comprising a drive wheel mounted between two slippage washers wherein said drive wheel rotatably slips about said clutch means until a staple is driven by said staple driving device;

(e) means for adjusting the rotational slippage of said drive wheel about said clutch assembly; and (f) spring means mounted on said base plate and biased against said pivot plate for engaging said drive wheel with staples.

12. The device as claimed in claim 11 wherein said clutch means further comprises:

(a) a collar assembly mounted on said rotatable shaft, said collar having a mounting flange adjacent its first end and a stud shaft at its second end extending axially along a longitudinal axis of said rotatable shaft;

(b) a first slippage washer axially mounted on said stud shaft adjacent said mounting flange and rotatable thereabout;

(c) a drive wheel having a circumferential groove for receiving an elastomeric member, said drive wheel axially mounted on said stud shaft adjacent said first slippage washer and rotatable thereabout;

(d) a second slippage washer axially mounted on said stud shaft adjacent said drive wheel and rotatable therebout;

(e) a thrust disc axially mounted on said stud shaft adjacent said second slippage washer;

(f) a tension washer axially mounted on said stud shaft adjacent said thrust disc;

(g) a disc axially mounted on said stud shaft adjacent said tension washer; and (h) a nut mated to said stud shaft for adjusting said tension washer and rotatability of said drive wheel.

13. The device as claimed in claim 12, further including a lever extending from said pivot plate for manually shifting said elastomeric member contained on said drive wheel out of contact with said fasteners.

14. The device as claimed in claim 13 wherein said elastomeric member comprises an O-ring.

15. The device as claimed in claim 14 wherein said first and second slippage washers are constructed from a polymeric material.

16. The device as claimed in claim 15, further including a shroud to protect said drive means from the environment.

* * * * *